US008166944B2

(12) United States Patent
Van den Bergh

(10) Patent No.: US 8,166,944 B2
(45) Date of Patent: May 1, 2012

(54) METHOD FOR STARTING AN INTERNAL COMBUSTION ENGINE

(75) Inventor: Ruben Van den Bergh, Rutesheim (DE)

(73) Assignee: Dr. Ing. h.c. F. Porsche AG, Stuttgart (DE)

( * ) Notice: Subject to any disclaimer, the term of this patent is extended or adjusted under 35 U.S.C. 154(b) by 135 days.

(21) Appl. No.: 12/617,272

(22) Filed: Nov. 12, 2009

(65) Prior Publication Data

US 2010/0206257 A1 Aug. 19, 2010

(30) Foreign Application Priority Data

Feb. 13, 2009 (DE) ..... 10 2009 008 816

(51) Int. Cl.
*F02D 17/04* (2006.01)

(52) U.S. Cl. ..... 123/179.17

(58) Field of Classification Search ..... 123/179.17, 123/339.1, 339.14; 701/103, 113
See application file for complete search history.

(56) References Cited

U.S. PATENT DOCUMENTS

| | | | | |
|---|---|---|---|---|
| 5,681,991 | A * | 10/1997 | Hatfield et al. | 701/103 |
| 6,351,943 | B1 * | 3/2002 | Tagami et al. | 60/285 |
| 6,470,854 | B1 | 10/2002 | Hirata et al. | |
| 2002/0179070 | A1 * | 12/2002 | Inoue et al. | 123/339.1 |
| 2003/0041831 | A1 | 3/2003 | Aoki et al. | |
| 2005/0178358 | A1 * | 8/2005 | Nakane | 123/339.19 |
| 2008/0154485 | A1 * | 6/2008 | Yasuda et al. | 701/113 |
| 2009/0063029 | A1 * | 3/2009 | Steuernagel et al. | 701/113 |
| 2009/0164102 | A1 * | 6/2009 | Olbrich et al. | 701/103 |
| 2011/0137543 | A1 * | 6/2011 | Gibson et al. | 701/113 |

FOREIGN PATENT DOCUMENTS

| | | | |
|---|---|---|---|
| DE | 10 2006 032 548 | A1 | 1/2008 |
| JP | 8014080 | A | 1/1996 |
| JP | 2001032739 | A | 2/2001 |
| JP | 2003065105 | A | 3/2003 |

* cited by examiner

*Primary Examiner* — Stephen K Cronin
*Assistant Examiner* — Arnold Castro

(57) ABSTRACT

In a method for starting an internal combustion engine, immediately before a predetermined idling speed is reached for the first time, a rate of injection of fuel into at least one combustion chamber of the internal combustion engine is reduced for at least one cycle of the internal combustion engine.

7 Claims, 3 Drawing Sheets

METHOD FOR STARTING AN INTERNAL COMBUSTION ENGINE

CROSS-REFERENCE TO RELATED APPLICATION

This application claims the priority, under 35 U.S.C. §119, of German application DE 10 2009 008 816.4, filed Feb. 13, 2009; the prior application is herewith incorporated by reference in its entirety.

BACKGROUND OF THE INVENTION

Field of the Invention

The invention relates to a method for starting an internal combustion engine, and to a control and/or regulating device for an internal combustion engine, and to a computer program.

The starting of an internal combustion engine frequently results in the internal combustion engine being operated towards the end of the starting phase and immediately after the start at a speed which lies above an "idling speed" at which the internal combustion engine is normally operated when idling. This is referred to as overshooting of the speed. Overshooting of the speed leads to increased fuel consumption and is also perceived to be uncomfortable, for example by the driver of a motor vehicle driven by the internal combustion engine.

It is known from the market to compensate for an overshooting of the speed by an ignition angle adjustment. The ignition angle adjustment in this case is realized by an ignition angle retardation which results in a reduction in the torque of the internal combustion engine.

The known method has the disadvantage that the ignition angle retardation leads to poor efficiency of the internal combustion engine and therefore causes greater fuel consumption.

If the internal combustion engine is started in a still hot state, a particularly high starting torque is achieved. It is frequently no longer possible for the starting torque to be completely compensated for by the known method, since the ignition angle retardation then provides only an inadequate possibility of adjusting the torque of the internal combustion engine. The known method is therefore not suitable, or only inadequately suitable, for example, for use in a start-stop mode in which the internal combustion engine is automatically turned off and turned on again.

Published, German patent application DE 10 2006 032 548 A1 shows a method for starting an internal combustion engine, which method can preferably be used in the start-stop mode. In the known method, it is checked prior to the start whether an overshooting of the speed of the internal combustion engine should be anticipated. If this is the case, fuel to at least one cylinder is shut off within the starting phase. As a result, the torque of the internal combustion engine is reduced. The disadvantage in this case is a possible "sputtering" of the internal combustion engine in the starting phase, which is regarded subjectively by a driver as being associated with a problem and as being uncomfortable.

SUMMARY OF THE INVENTION

It is accordingly an object of the invention to provide a method for starting an internal combustion engine, which overcomes the above-mentioned disadvantages of the prior art devices of this general type, which effectively reduces an overshooting of the speed after a start of the internal combustion engine in as simple a manner as possible and to therefore increase the comfort and reduce the fuel consumption.

The object is achieved by a method for starting an internal combustion engine in that, immediately before or after a predetermined idling speed is reached for the first time, a rate of injection of fuel into at least one combustion chamber of the internal combustion engine is reduced for at least one cycle of the internal combustion engine. In this case, the term "cycle" is understood as meaning two crankshaft revolutions, i.e. 720°. The term "operating cycle" is also usable for this.

The invention is based on the idea the speed of the internal combustion engine during the starting phase by specific regulation of the rate of injection to reduce the overshooting of the speed of the internal combustion engine above the idling speed. In this case, the rates of injection can vary in the different combustion chambers. The rate of injection determined by a computer program, which is executable in a control and/or regulating device of the internal combustion engine, therefore deviates from a stoichiometric rate of injection. According to the invention, an air/fuel mixture is substoichiometric or "lean". According to the definition, the stoichiometric rate of injection is the rate of fuel required in a ratio to a defined rate of air for complete combustion of the fuel used without oxygen lacking or being left over. At a higher proportion of fuel, an air/fuel mixture is called "rich" and at a lower proportion of fuel an air/fuel mixture is called "lean".

Operating parameters of the internal combustion engine that are available to the control and regulating device, such as, for example, temperature of the internal combustion engine, torque demand, ambient pressure, an ignition angle or period of time from the last stop can also be included in the determination of the particular rate of injection. The method according to the invention therefore saves fuel and improves the subjective perception of the driver during the starting operation.

The method is preferably suitable for use in a start-stop mode of the internal combustion engine. In the start-stop mode, the internal combustion engine is stopped whenever the vehicle is stationary, for example at a red light. After the stop, it suffices, for example, merely to touch the accelerator pedal and the motor is automatically started again. Vehicles with a start-stop mode emit less $CO_2$ and consume less fuel. For the starting method, this means that a subsequent "restart" after a stop is predominantly a hot start which, unlike a customary starting method, does not have to be operated with a "rich" and therefore power-supplying air/fuel mixture. The latter is necessary only for a cold start. During the restart, the "rich" air/fuel mixture can easily bring about a severe overshooting of the speed. The overshooting of the speed and an associated unnecessary increase in the torque are effectively prevented by the reduction according to the invention in fuel when the idling speed is reached.

It is also advantageous that the rate of injection is reduced by a reduction factor, the reduction factor lying between 30 and 100%. In this case, immediately before the idling speed is reached (approximately 25% below the idling speed), there can preferably be a sudden, sharp reduction in the rate of injection essentially stopping the speed from increasing. In this case, the reduction in the rate of injection has to be dimensioned such that, although the idling speed is reached, the speed is only scarcely increased and later is no longer increased at all subsequently in the following cycles. This is assisted by a further variation in the particular rate of injection, since the sudden, sharp reduction in the rate of injection can preferably be followed by a substantially smaller variation in the reduction in the rate of injection. The reduction factor may be constant over the various cycles, but may also be variable.

Over the further course of the starting operation, the speed is reduced by the continuous reduction in the rate of injection such that the idling speed is reached again. Therefore, it is furthermore proposed for the invention that, shortly before the idling speed is reached for the second time, the rate of injection is increased again. The rate of injection has to be increased again in good time in order to keep the internal combustion engine running. A corresponding offset with respect to the idling speed is predetermined in the control and/or regulating device as a fixed value or a function dependent on an operating variable of the internal combustion engine. The offset is preferably approximately 25% above the idling speed. Since the time is already located towards the end of the starting phase and the internal combustion engine is already running approximately true after completing a number of cycles, it is now possible to settle the rate of injection in such a manner that the internal combustion engine reaches the idling speed again and subsequently retains the latter essentially until the starting phase is at an end.

Other features which are considered as characteristic for the invention are set forth in the appended claims.

Although the invention is illustrated and described herein as embodied in a method for starting an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
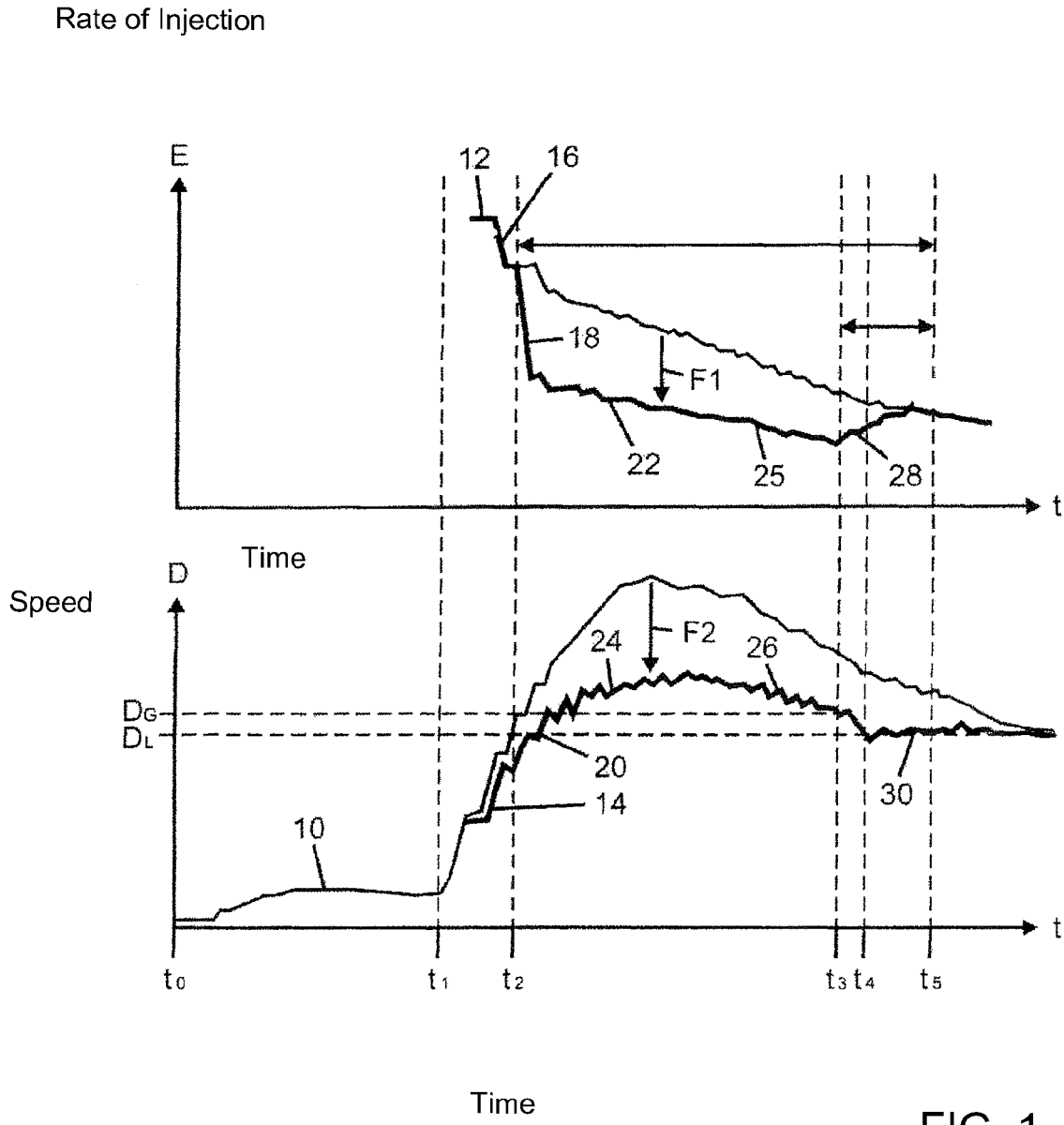
FIG. 1 is a graph showing a variation over time of a rate of injection and a variation of speed in a starting phase in an internal combustion engine at a restart in a start-stop mode.

Referring now to the figures of the drawing in detail and first, particularly, to FIG. 1 thereof, there is shown, in an upper region, a variation over time of a rate of injection E during a starting phase of a motor vehicle at a restart in a start-stop mode. In a lower region, the variation over time of a speed D of the internal combustion engine during the starting phase in the start-stop mode is shown. In both illustrations, a thin line represents a possible variation without the use of the method according to the invention, i.e. a variation in a conventional method; the thick line shows the particular variation with the use of the method according to the invention. The method according to the invention is controlled by a computer program which is executable in a control and regulating device of the internal combustion engine.

At time $t_0$, a starter motor for starting the motor vehicle is actuated and the speed D is increased in accordance with the speed of revolution of the starter motor (see reference sign 10). At the time $t_1$, an injection into a combustion chamber of the internal combustion engine begins. In this case, the rate of injection E is relatively high (see reference sign 12) in order to produce a "rich" and therefore power-supplying air/fuel mixture in the first cycles with an ignition in the combustion chamber. In this case, the term "cycle" is understood as meaning two crankshaft revolutions, i.e. 720°. The speed D rises rapidly in this case (see reference sign 14). However, during the cycles, the rate of injection E is already reduced (see reference sign 16) and the speed D continues to increase.

Shortly before an idling speed $D_L$, which is predetermined in the control and regulating device, is reached at the time $t_2$ (approximately 25% below the idling speed), the rate of injection E is suddenly and drastically reduced (see reference sign 18). However, because of the inertia, the speed D nevertheless increases (see reference sign 20), but the acceleration of the change in speed is sharply retarded. After the drastic reduction in the rate of injection E (see reference sign 18), the rate of injection E per cycle is only reduced a little (see reference sign 22); the speed D nevertheless increases slightly (see reference sign 24) in order then, after a further reduction in the rate of injection E (see reference sign 25), finally to drop again (see reference sign 26). As is apparent from FIG. 1, the lowering of the rate of injection E brings about a reduction in the fuel consumption by the factor $F_1$ in comparison to a conventional method. As a result, a reduction in the speed D by a factor $F_2$ is also realized, which brings about an inadvertent and annoying overshooting of the speed D.

A limit value $D_G$ for the speed D, the limit value lying above the idling speed $D_L$ is defined in the control and regulating device. The limit value $D_G$ indicates at which speed D the injection E has to be increased again in order to keep the internal combustion engine running during the starting phase. Operating parameters of the internal combustion engine that are available to the control and regulating device, such as, for example, temperature of the internal combustion engine, torque demand, ambient pressure, an ignition angle or a period of time from the last stop, can also be incorporated into the control system. The limit value $D_G$ that is defined in such a manner and acts during the reduction in speed is reached at the time $t_3$. FIG. 1 shows the rise in the rate of injection E (see reference sign 28) before the time $t_3$. However, the speed D initially continues to drop because of the inertia as far as the time $t_4$ where the idling speed $D_L$ is reached again. The internal combustion engine is already running in a customarily stable manner a number of cycles after the start. The control and regulating device is now in the position of settling the rate of injection E as far as the end of the starting phase in such a manner that the speed D is kept to the idling speed $D_L$ (see reference sign 30). The starting phase is finished at the time $t_5$.

Figure 2:
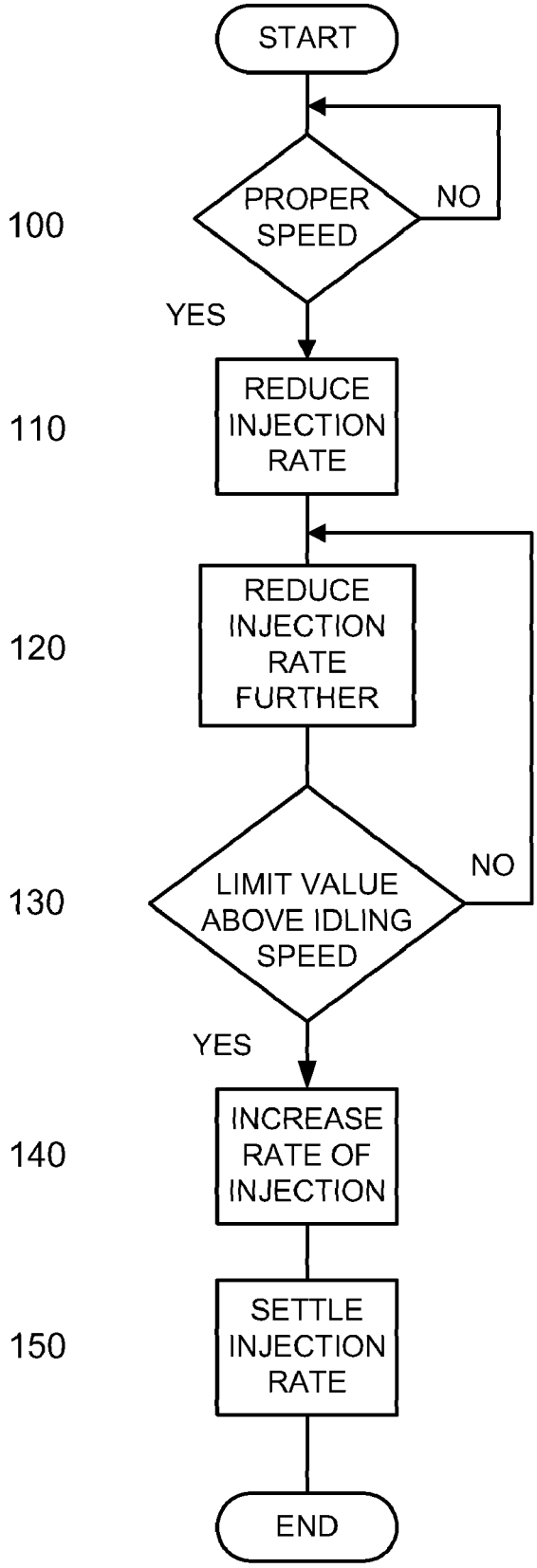
FIG. 2 is a flow diagram showing a method sequence according to the invention.

FIG. 2 shows a flow diagram of a possible sequence of the starting phase during a restart in the start-stop mode. At the START, the starter motor of the motor vehicle is running, the first injection begins and the speed D of the internal combustion engine increases. In step 100, the control and regulating device enquires whether the speed D of the internal combustion engine has reached the predetermined speed D (approximately 25% below the idling speed). If this is the case, the rate of injection E is drastically reduced in step 110 (see reference sign 18 in FIG. 1). Subsequently, in step 120, the rate of injection E per cycle is only reduced to a small extent (cf. reference signs 24 and 26 in FIG. 1). It is subsequently enquired in step 130 whether the limit value $D_G$ above the idling speed $D_L$ (approximately 25% above the idling speed) has been reached. If this is the case (time $t_3$), the rate of injection E is increased again in step 140 (see reference sign 28 in FIG. 1). Subsequently, in step 150, the rate of injection E is settled by the control and regulating device in such a manner that the idling speed $D_L$ can be maintained until the end of the starting phase.

Figure 3:
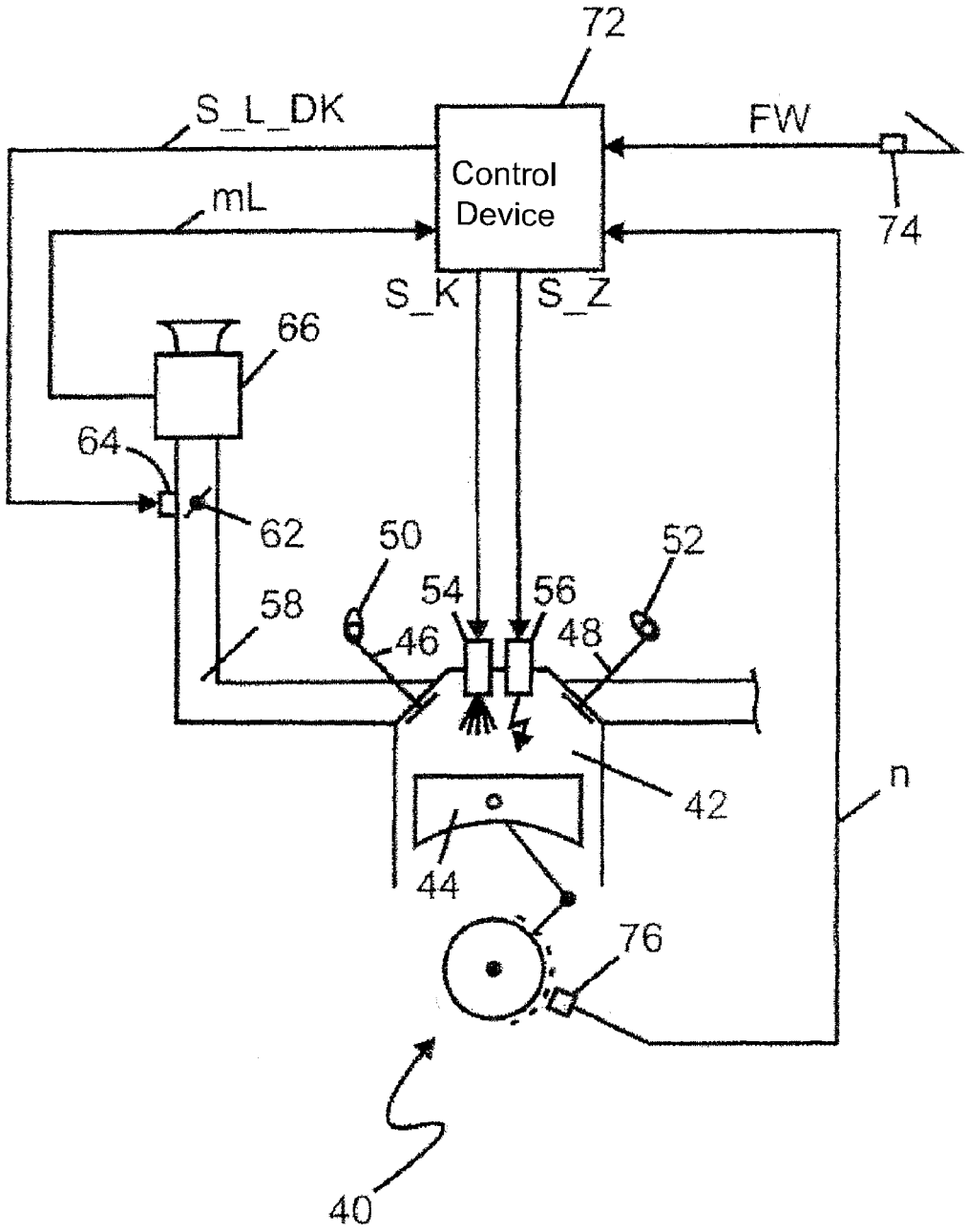
FIG. 3 is a schematic illustration of an internal combustion engine.

FIG. 3 shows the technical environment of the invention. In detail, FIG. 3 shows the internal combustion engine 40 with the combustion chamber 42 which is sealed in a movable manner by a piston 44. A change in the chargings of the combustion chamber 42 is controlled by at least one inlet valve 46 and one outlet valve 48 which are actuated for this purpose by corresponding actuators 50, 52. In the configuration of FIG. 3, an injector 54 serves to meter fuel into an air charge in the combustion chamber 42. The resulting mixture of fuel and air is ignited by a spark plug 56. The combustion chamber 42 is charged with air from an intake pipe 58 which has a throttle valve 62, which is actuated by a throttle valve adjuster 64, and an air mass meter 66.

The internal combustion engine 40 is controlled by the control and regulating device 72 which, for this purpose, processes signals in which various operating parameters of the internal combustion engine 40 are depicted. In the illustration of FIG. 3, the signals are in particular signals mL for the air mass meter 66, the signal FW from a driver demand transducer 74, which detects a torque demand by the driver, and the signal n from a speed transducer 76 which detects a speed n of a crankshaft of the internal combustion engine 40.

It goes without saying that modern internal combustion engines 40 are equipped with a multiplicity of further transducers and/or sensors which are not illustrated here for reasons of clarity. Examples of such sensors include temperature sensors, pressure sensors, exhaust gas sensors, etc. In this respect, the enumeration of the transducers 66, 74 and 76 is not meant to be definitive. A dedicated sensor also does not have to be present for each operating parameter processed by the control and regulating device 72 because the control and regulating device 72 can simulate different operating parameters from other measured operating parameters with the aid of computer models.

From the transducer signals received, the control and regulating device 72 forms, inter alia, control variables for adjusting the torque which is to be generated by the internal combustion engine 40. In the configuration of FIG. 3, the control variables are in particular a control variable S_K for activating the injector 54, a control variable S_Z for activating the spark plug 56 and a control variable S_L_DK for activating the throttle valve adjuster.

Furthermore, the control and regulating device 72 is set up, in particular programmed, in order to carry out the method according to the invention or one of the refinements thereof and/or to control the corresponding method sequence.

The invention claimed is:

1. A method for starting an internal combustion engine, which comprises the steps of:

reducing a rate of injection of fuel into at least one combustion chamber of the internal combustion engine for at least one cycle of the internal combustion engine immediately before a predetermined idling speed is reached for a first time; and increasing the rate of injection again shortly before the predetermined idling speed is reached for a second time.

2. The method according to claim 1, which further comprises performing the method during a start-stop mode of the internal combustion engine.

3. The method according to claim 1, which further comprises reducing the rate of injection by a reduction factor.

4. The method according to claim 3, wherein the reduction factor is variable.

5. The method according to claim 3, wherein the reduction factor lies between 30 and 100%.

6. The method according to claim 3, wherein the reduction factor is constant.

7. A method for starting an internal combustion engine, which comprises the step of:

reducing a rate of injection of fuel into at least one combustion chamber of the internal combustion engine for at least one cycle of the internal combustion engine immediately before a predetermined idling speed is reached for a first time, wherein a reduction in the rate of injection produces a substoichiometric air/fuel ratio.

* * * * *